United States Patent [19]

Preuninger et al.

[11] 4,118,906

[45] Oct. 10, 1978

[54] CONCRETE VESSEL HAVING WALL APERTURES LINED WITH TUBULAR INSERTS

[75] Inventors: Manfred Preuninger, Ilsfeld-Schozach; Gottfried Hollender, Brackenheim; Herbert Schaber, Heilbronn, all of Fed. Rep. of Germany

[73] Assignee: Cillichemie Ernst Vogelmann, Heilbronn, Fed. Rep. of Germany

[21] Appl. No.: 771,963

[22] Filed: Feb. 25, 1977

[30] Foreign Application Priority Data

May 25, 1976 [DE] Fed. Rep. of Germany ..... 2623388

[51] Int. Cl.[2] ..... E04B 1/40

[52] U.S. Cl. ..... 52/100; 52/707; 52/708; 52/699

[58] Field of Search ..... 52/699, 721, 704, 707, 52/708, 711, 302, 303, 305, 220, 221, 99, 100

[56] References Cited

U.S. PATENT DOCUMENTS

| | | | |
|---|---|---|---|
| 2,923,146 | 2/1960 | Mayer | 52/704 |
| 2,957,279 | 10/1960 | McNair | 52/704 |
| 3,048,911 | 8/1962 | Alnon | 52/221 |
| 3,220,079 | 11/1965 | Aggson | 52/302 |
| 3,731,448 | 5/1973 | Leo | 52/220 |
| 4,026,082 | 5/1977 | Crofoot | 52/302 |

FOREIGN PATENT DOCUMENTS

| | | | |
|---|---|---|---|
| 658,720 | 3/1963 | Canada | 52/305 |
| 1,250,094 | 9/1967 | Fed. Rep. of Germany | 52/707 |
| 307,657 | 1/1969 | Sweden | 52/701 |
| 195,324 | 3/1923 | United Kingdom | 52/699 |

OTHER PUBLICATIONS

Unsaturated Polyester ©1956 by Reinhold Publishing Corp., pp. 90–96.

*Primary Examiner*—Price C. Faw, Jr.
*Assistant Examiner*—Henry Raduazo
*Attorney, Agent, or Firm*—Hans Berman

[57] ABSTRACT

Apertures in the cast concrete walls of a swimming pool are lined with tubular inserts entirely received in the apertures in sealing, conforming engagement with the concrete. The length of each insert in the direction of wall thickness is equal to or shorter than the corresponding length of the receiving aperture. The insert essentially consists of a solid mixture of a particulate, rigid, inorganic material, such as quartz sand, and a smaller amount of a more resilient, synthetic organic resin binder. A fastening flange is provided in the bore of the insert for fastening the insert in a form while the wall is being built by pouring fluid concrete mixture into the form. The flange provides a fastening base for later installed fittings, pumps, etc. During construction of the swimming pool, a form bounding a cavity is erected. The afore-mentioned insert is secured in the form by means of the fastening means, and fluid concrete mixture is poured into the form cavity until the insert is enveloped by the concrete mixture. After curing of the concrete mixture, the form is removed.

11 Claims, 11 Drawing Figures

CONCRETE VESSEL HAVING WALL APERTURES LINED WITH TUBULAR INSERTS

This invention relates to vessels having walls of cast or poured concrete, and particularly to a vessel having such walls formed with apertures therethrough.

The invention will be described hereinbelow in its specific application to a vessel which is a swimming pool, but it is not limited to any specific application.

Practically all large swimming pools have upright and bottom walls of cast concrete, the term being used herein to designate the hard product obtained by spontaneous curing of a fluid mixture of Portland cement, aggregate, and water. Apertures in the swimming pool walls are necessary for supplying and withdrawing water from the cavity of the pool and for other purposes, and liners of materials other than concrete are often arranged in the apertures for connection to various operating elements.

Tubular liners of metal and plastic were embedded in the concrete walls of swimming pools prior to this invention. They have a useful life much shorter than that of the concrete walls, and they are not readily repaired or replaced without requiring partial destruction and reconstruction of the adjacent concrete.

It is a primary object of this invention to provide a vessel having an apertured wall of cast concrete with a tubular liner or insert for the aperture which is as durable and resistant to environmental influences as the concrete of the wall, but permits operating elements for the swimming pool to be connected thereto and to absorb stresses generated by such elements more readily than the brittle concrete.

According to one aspect of this invention a tubular insert received in the aperture of the cast concrete wall of the vessel is as long as or shorter than the length of the aperture in a direction through the wall. The insert is received in the wall aperture in sealing, conforming engagement with the concrete of the wall. The insert essentially consists of a solid mixture of a particulate, rigid, organic material and of a more resilient, synthetic organic resin binder. Fastening means are provided on the insert which permit the same to be fastened in the interior of a form while the wall is being built by pouring fluid concrete mixture into the form.

Figure 1A:
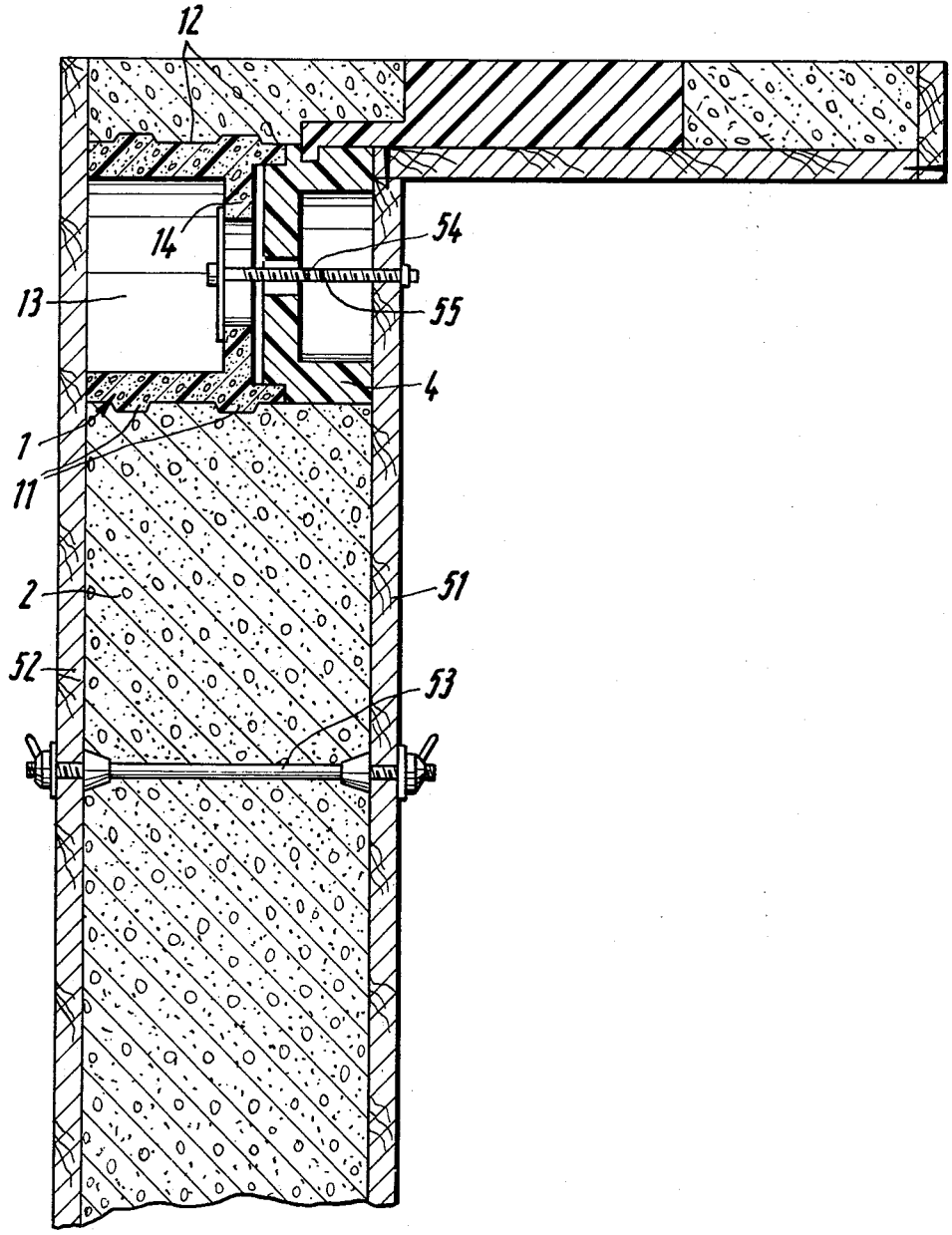
Figure 1B:
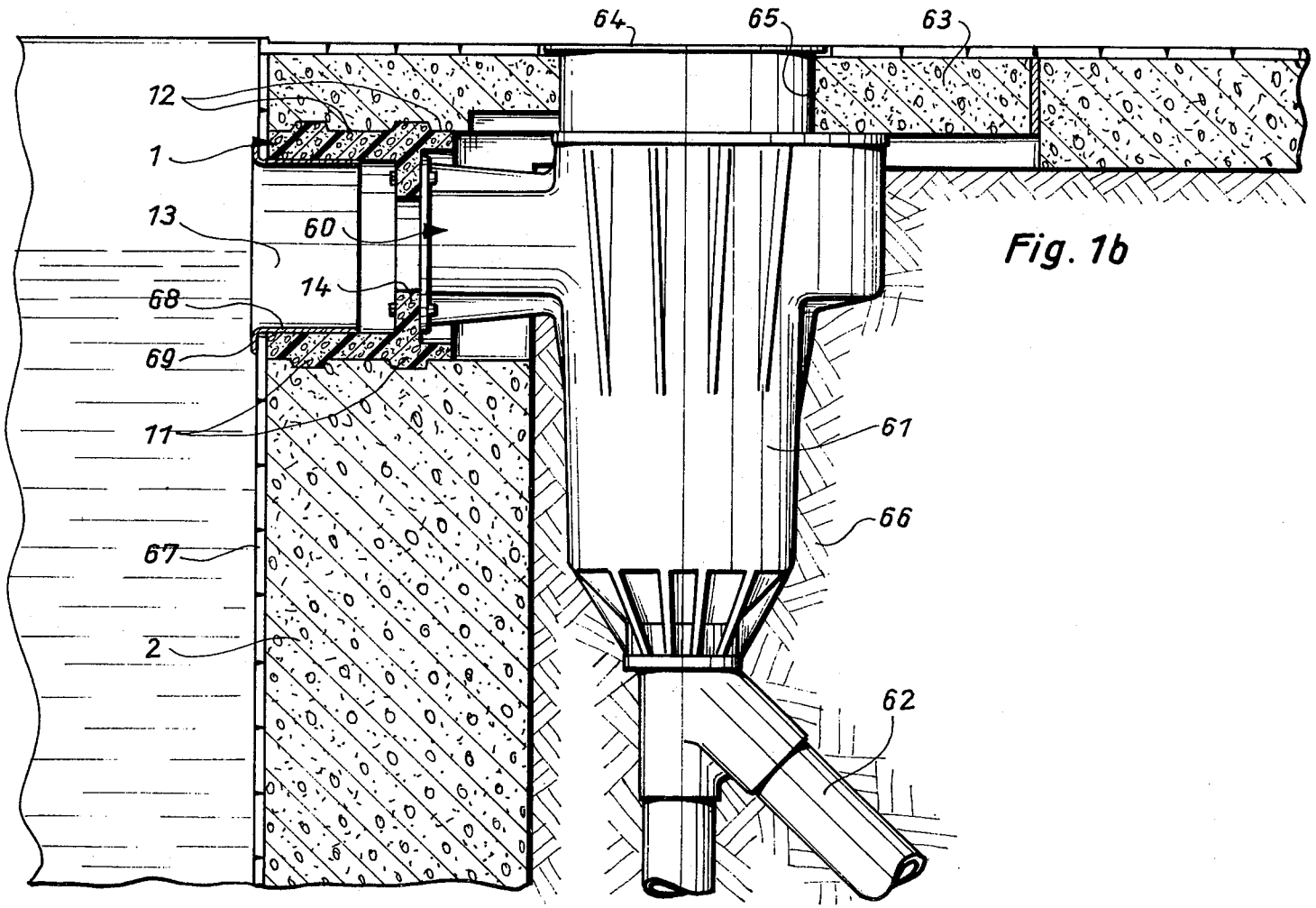
Figure 1C:
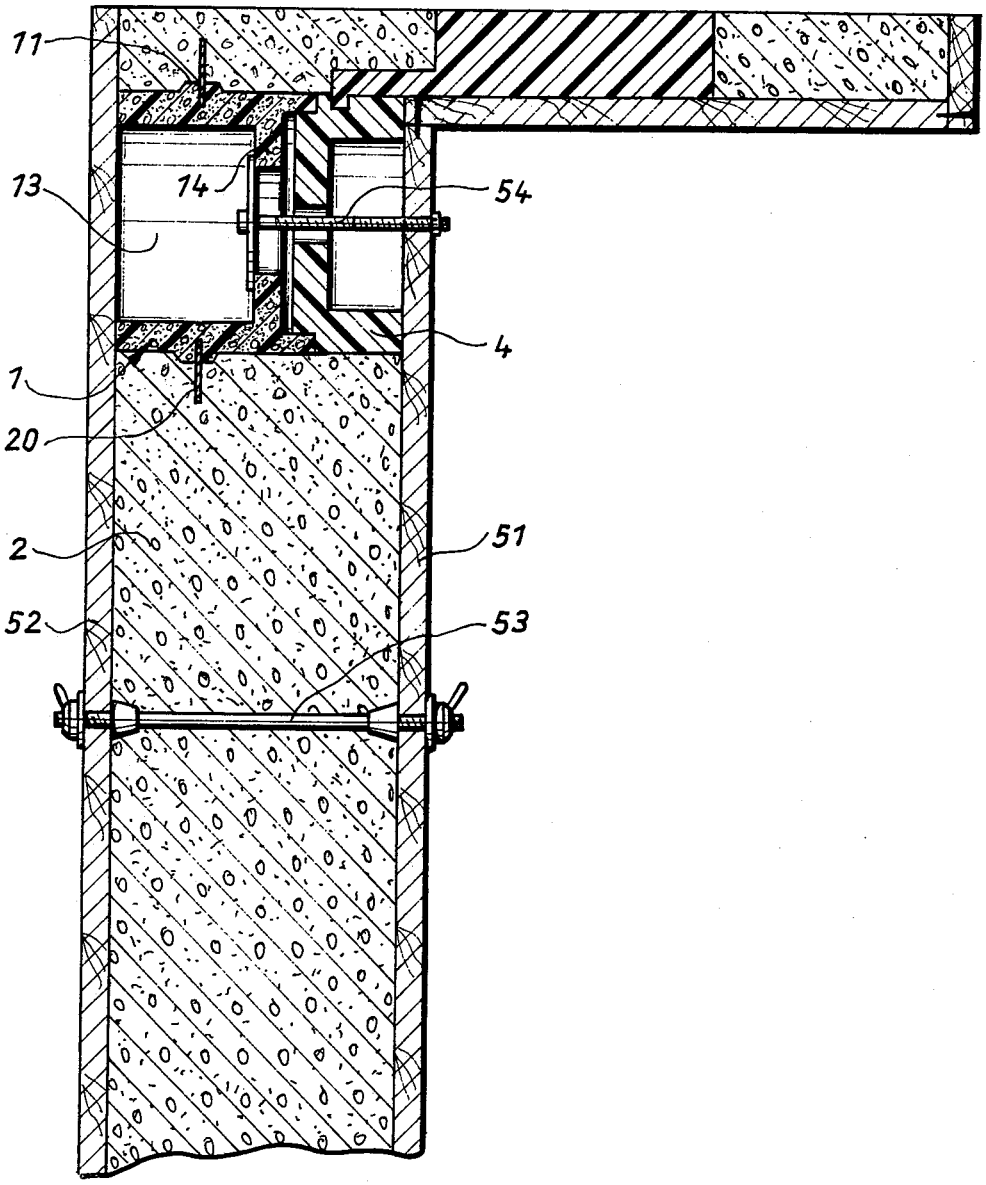

Other features, additional objects, and many of the attendant advantages of this invention will readily be appreciated as the same becomes better understood from the following detailed description of preferred embodiments when considered in connection with the appended drawing in which:

FIG. 1*a* is a fragmentary elevational section of a swimming pool including a tubular insert of the invention, the pool being shown during its construction;

FIG. 1*b* illustrates the device of FIG. 1*a* in the completed condition;

FIG. 1*c* shows a modification of the device of FIG. 1*a;*

Figure 2A:
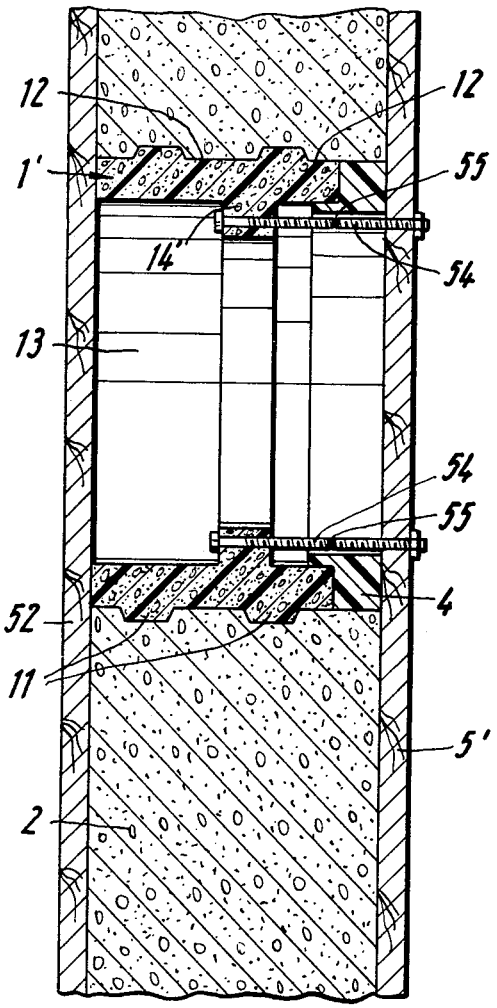

FIG. 2*a* illustrates another portion of the same swimming pool in a view corresponding to that of FIG. 1*a;*

Figure 2B:
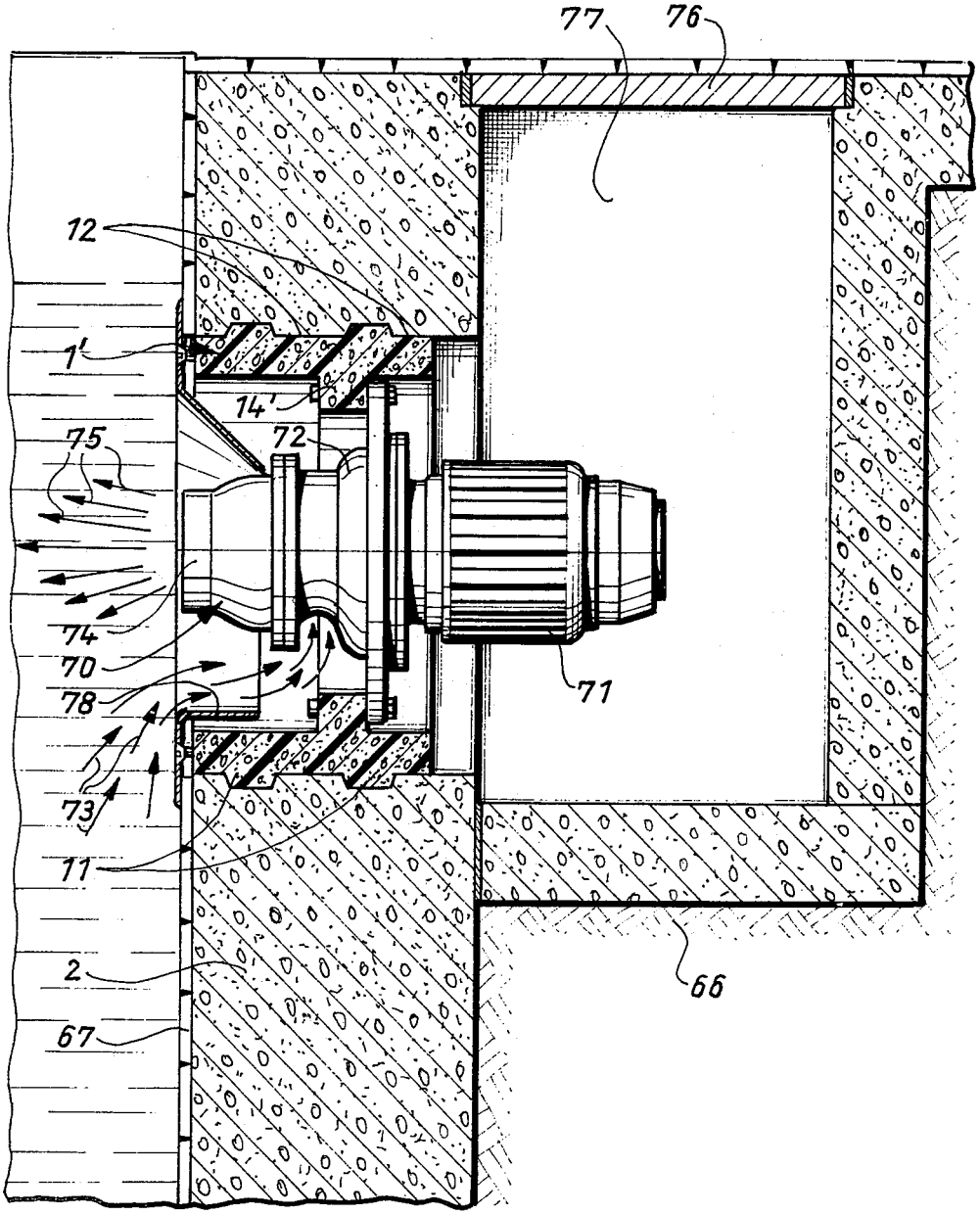
Figure 3A:
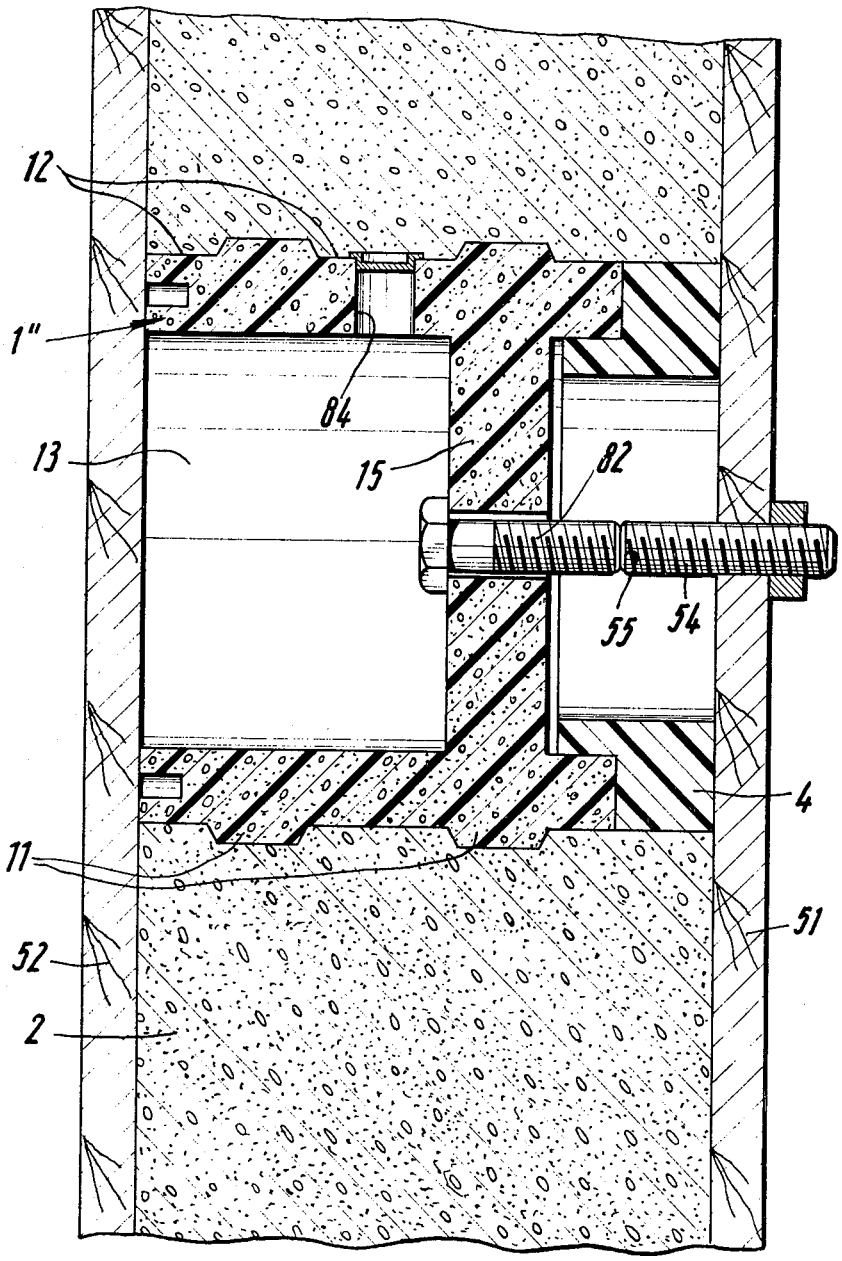
Figure 3B:
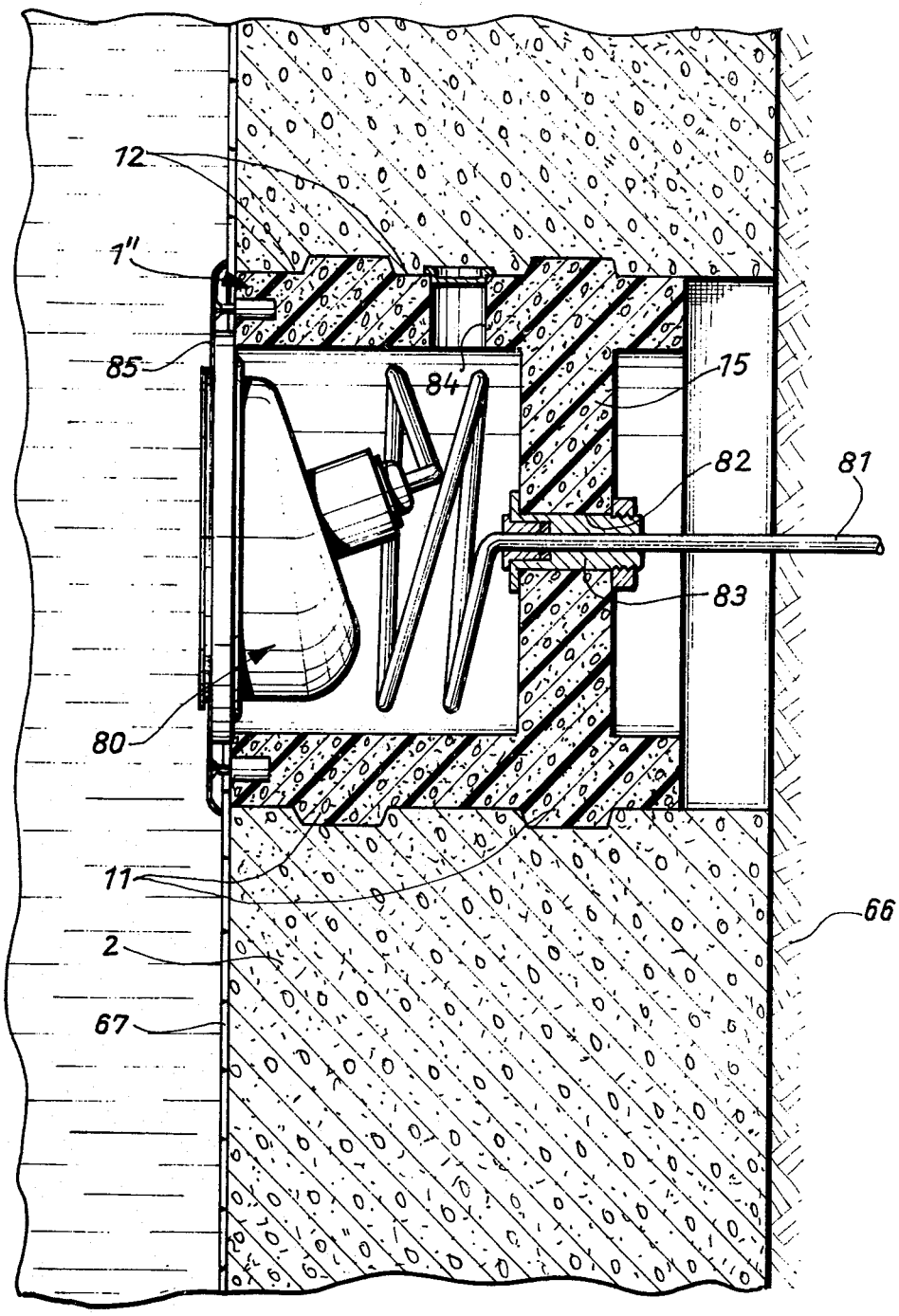
Figure 3C:
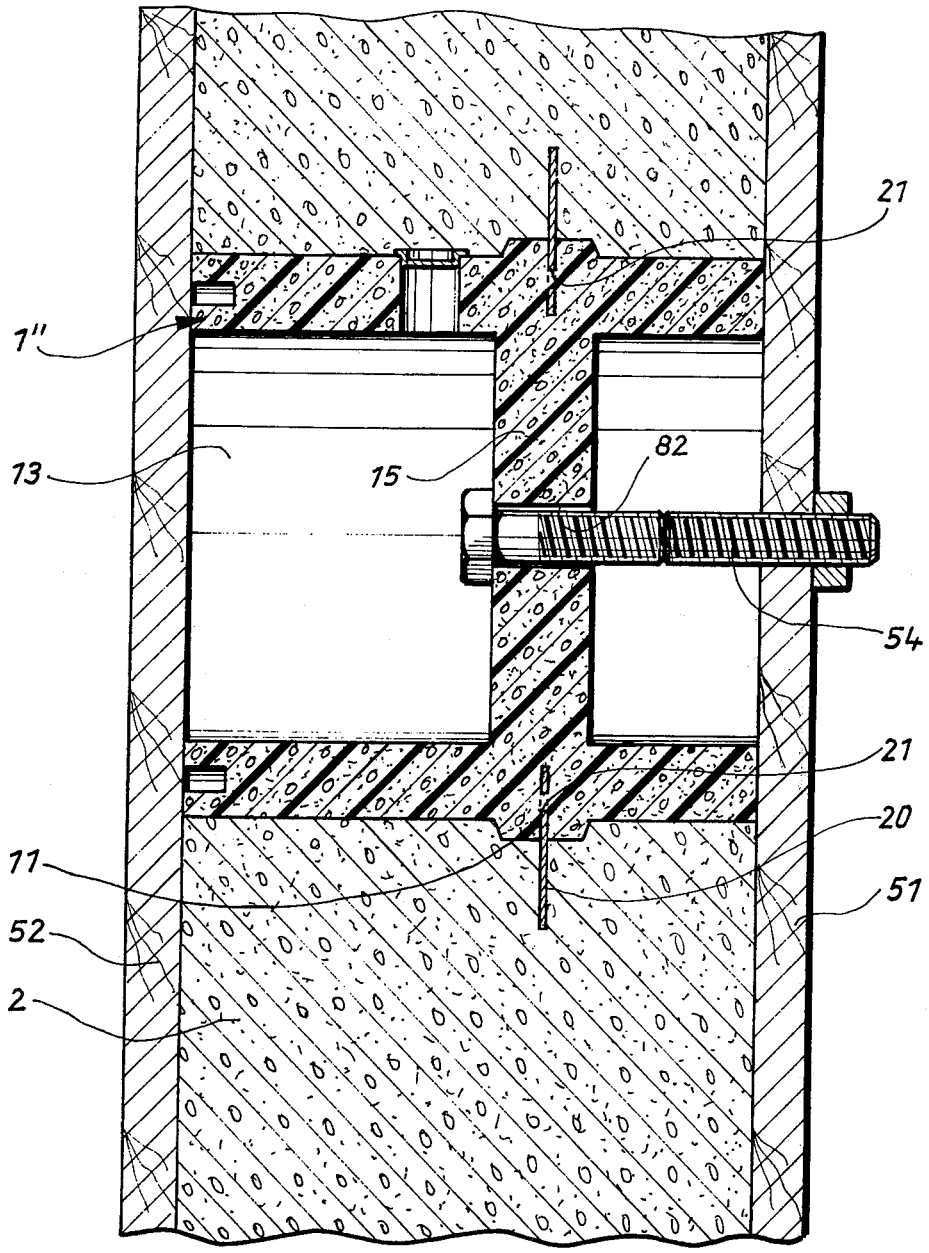

FIG. 2*b* illustrates the swimming pool portion of FIG. 2*a* as completed;

FIG. 3*a* is an elevational sectional view of yet another portion of the pool during its construction;

FIG. 3*b* is a corresponding view of the pool portion of FIG. 3*a* in the completed condition;

FIG. 3*c* shows a modification of the device of FIG. 3*a;*

Figure 4A:
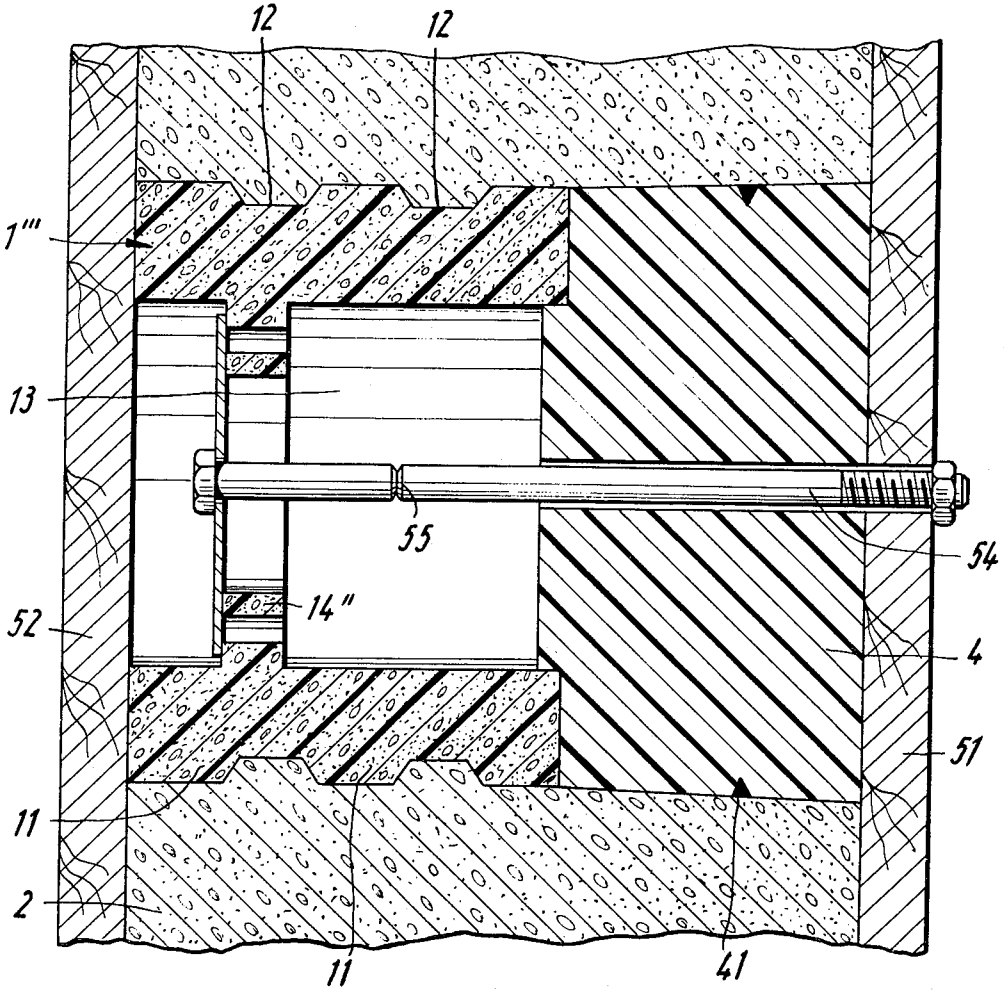
Figure 4B:
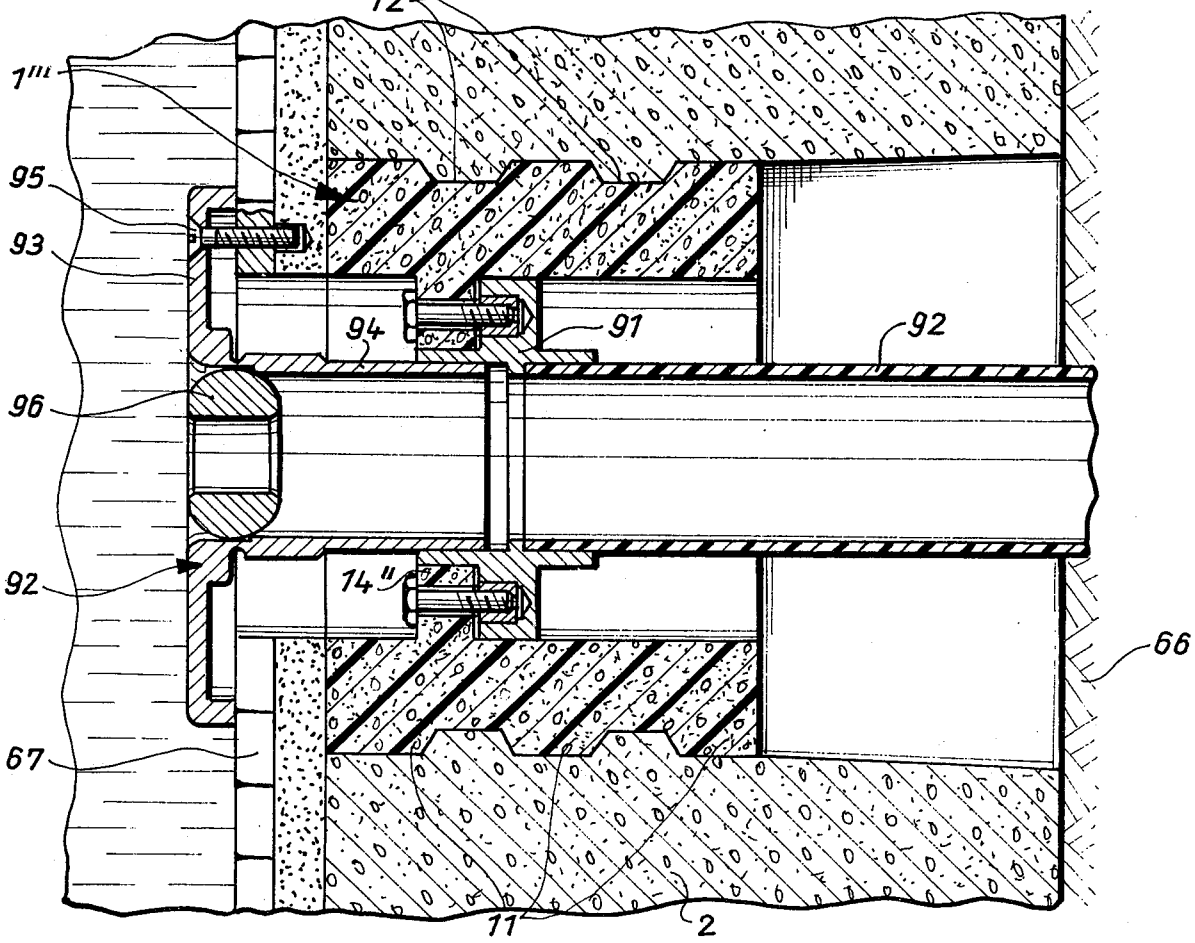
Figure 5:
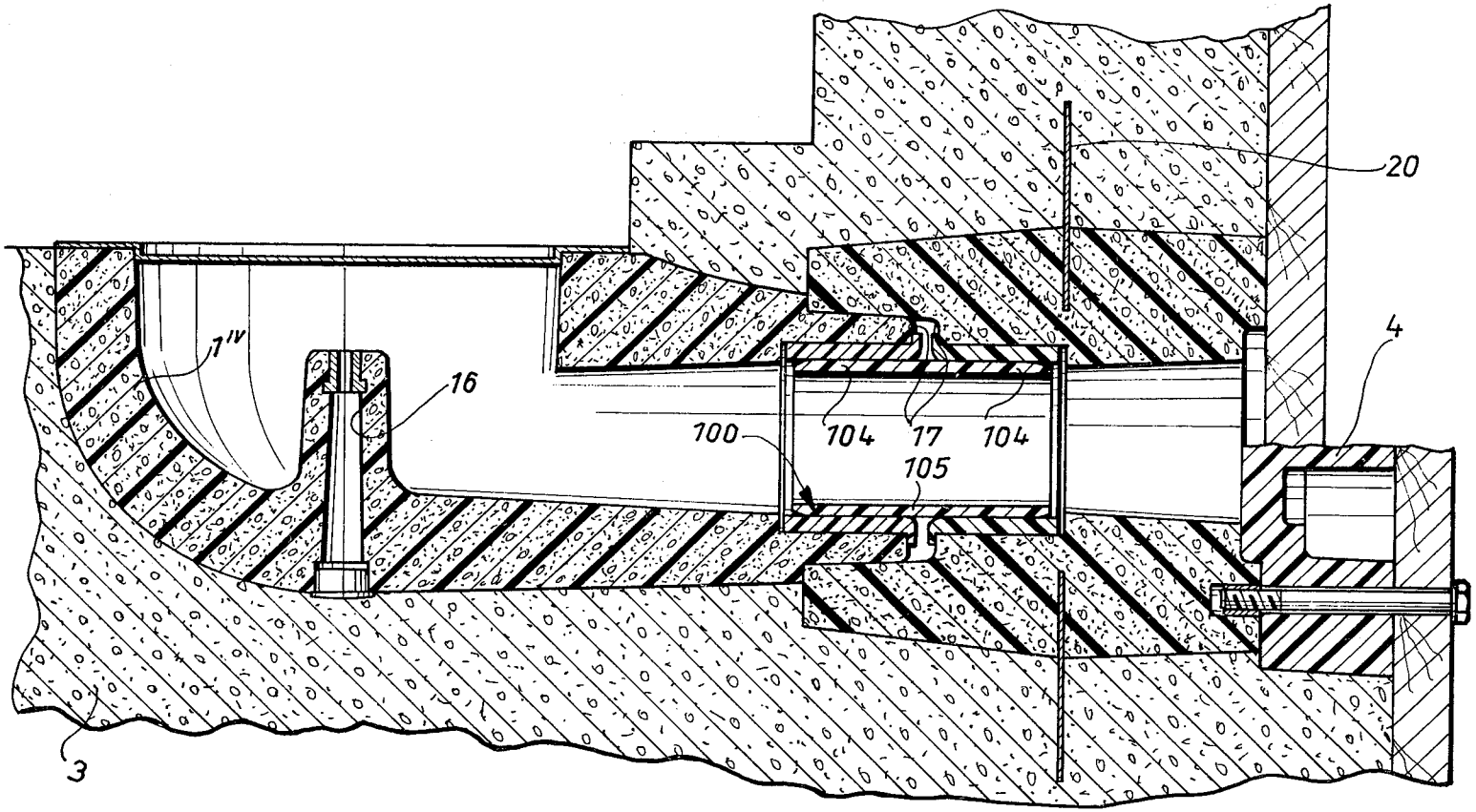

FIGS. 4*a* and 4*b* respectively illustrate a further portion of the same pool during its construction and after completion; and FIG. 5 shows a bottom corner of the pool in elevational section during its construction.

Referring now to the drawing in detail, and initially to FIG. 1*a*, there are shown the top edge of a concrete pool and a narrow deck integral with the upright pool wall 2 which is still confined between an outer wooden form wall 51 and an inner form wall 52 bounding the cavity of the pool and connected to the form wall 51 by a multiplicity of threadedly fastened spacer rods 53. A tubular insert 1 of generally cylindrical shape about a horizontal axis is embedded in the concrete of the wall 2. It is flush with the inner, vertical face of the wall 2 so that its bore 13 is sealed in one axial direction by the form wall 52. Annular reinforcing ribs 11 project from the outer cylindrical face of the insert 1 into the concrete of the wall 2, and the concrete in turn fills the grooves 12 between the ribs 11.

Near the axial end of the insert 1 remote from the form wall 52, an integral radial flange 14 projects into the bore 13. The insert 1 was held in position during the pouring of the concrete wall 2 in the form 51, 52 by a stay bolt 54 anchored in the outer form wall 51. A washer on the stay bolt closes the opening bounded by the flange 14. The insert 1 was further held in position during the pouring of the wall 2 by a cup-shaped spacer 4 of cellular polystyrene which prevented the concrete mixture from entering a space in the wall 2 axially aligned with the insert 1 whose length is smaller than the wall thickness. A notch 55 in the stay bolt 54 permits the bolt to be broken with relative ease.

When the concrete has set, the form walls 51, 52 are removed. It is preferred to release the stay bolt 54 before removing the wall 51. If this is overlooked, damage to the flange 14 of the insert 1 during removal of the wall 51 is prevented by breaking of the bolt 54 at the notch 55. The spacer 4 also is removed.

The tubular insert 1 then provides anchorage and an inlet in the pool wall 2 for an overflow skimmer 60 as is shown in FIG. 1*b*. The space around the outside of the completed pool is filled with earth 66 on which the deck 63 rests. Access to the buried overflow vessel 61 of the skimmer 60 is provided by an opening 65 in the deck 63, normally closed by a round, removable cover 64. A pipe 62 leads from the bottom of the vessel 61 to a suction pump, not shown. The inner face of the upright pool wall 2 is covered with ceramic tiles 67 which also cover the annular end face of the insert 1 flush with the concrete face of the wall. A decorative inlet pipe 68 of bright metal is received in the insert 1 and has an outer radial flange 69 overlapping the tiles 67 near the orifice of the insert 1.

The insert is pre-fabricated and is installed between the form walls 51, 52 prior to the pouring of concrete mixture. It consists of inorganic, inert particles and a plastic binder cementing the particles to each other. Quartz sand provides the preferred particles in all inserts of the invention, and polyester resin binders, which are staple articles of commerce, are preferred. Depending on the specific nature of the polyester resin in the binder, the binder may further include curing and hardening agents, such as benzoyl peroxide, secondary binders, such as styrene, and coloring matter to give a more pleasing appearance to the parts of the insert which may be visible. An insert material which has been found very useful for all swimming pool applications illustrated consists basically of approximately 80% quartz sand or gravel having a grain size of 0.04 to 8 mm and 20% polyester resin.

Under most conditions, the insert 1 is adequately secured in an axial direction by the ribs 11 and grooves 12 conformingly interengaged with the concrete of the wall 2, but firmer anchorage is obtained by a flat annular disc 20 of sheet metal which is embedded in one of the reinforcing ribs 11 and projects from the rib into the surrounding concrete, as is shown in FIG. 1*c*, the illustrated portion of the swimming pool being otherwise identical with what has been described with reference to FIG. 1*a*.

The same vertical wall 2 shown in FIGS. 1*a*, 1*b*, 1*c* is provided at an intermediate level with another tubular insert 1' of the same material as the insert 1, but mounted between the form walls 51, 52 by means of several long bolts 54 passing through respective bores in the flange 14' of the insert 1', the heads of the bolts abutting against the inner radial face of the flange, and the shanks of the bolts passing through the outer form wall and carrying nuts. Notches 55 forming frangible, reduced portions of the bolts 54 are provided as described above. The insert 1' is axially longer than the insert 1, but still shorter than the aperture in the wall 2 in which it is set, the remainder of the aperture being sealed against ingress of fluid concrete mixture by a spacer ring 4 of cellular polystyrene interposed between the insert 1' and the outer form wall.

After curing of the concrete in the wall 2, the form walls, the bolts 54, and the spacer ring 4 are removed, and a circulating pump assembly 70 is mounted on the flange 14' by means of bolts as is shown in FIG. 2*b*. The electric motor 71 of the assembly projects outward of the pool wall 2 into a concrete-lined compartment 77 in the surrounding earth fill 66. Access to the compartment may be had through an opening releasably closed by a cover 76.

The motor drives an axial flow pump 72 arranged behind a baffle 78 in such a manner that water flows mainly from the bottom region of the pool toward the pump intake, as indicated by arrows 73, while the pump output is discharged through a nozzle 74 in a mainly horizontal direction, as indicated by arrows 75.

A further insert 1'' is installed between the form walls 51, 52 prior to pouring of the pool walls approximately on the same level as the pump assembly 80 in a manner evident from FIG. 3*a*. The element corresponding in the insert 1'' to the afore-described flanges 14, 14' is a partition 15 formed with a relatively small central, axial aperture 82. The insert 1'' is initially clamped to the outer form wall 51 by means of a bolt 54 having a frangible portion at a notch 55. The head of the bolt abuts against the outer radial face of the partition 15, and its shank passes through the form wall 51. A spacer ring 4 of cellular plastic is clamped between the form wall 51 and the outer, annular end face of the insert 1''.

As is seen in FIG. 3*b*, a floodlight 80 is mounted in the bore 13 of the insert 1'' after removal of the form walls 51, 52 and associated elements in the manner described above. The power supply cable 81 for the floodlight passes through a sealing plug 83 in the aperture 82, but the pre-fabricated insert 1'' is also provided with a radial passage 84 communicating with the bore 13 for accomodating a power cable and plugged in the illustrated embodiment. The floodlight 80 is held in position in the wall 2 by a flat mounting ring 85 which may also carry a pane of glass.

The modified insert 1'' shown in FIG. 3*c* is axially as long as the spacing of the form walls 51, 52, and thus as long as the thickness of the finished concrete wall 2. It does not need a spacer 4 to be held in position between the form walls during the pouring of concrete for the pool. A flat, annular disc 20 is anchored in one of the external reinforcing ribs 11 of the modified insert 1''. It is formed with a row of circumferentially distributed openings 21 therethrough which are filled with the material of the insert 1'' during the molding of the latter at elevated temperature and pressure from the mixture of quartz sand and polyester resin binder. After curing of the concrete in the pool wall 2, the modified insert 1'' serves as a mounting base and receptacle for a floodlight in the manner shown in FIG. 3*b*.

Water is fed to the pool partly illustrated in the drawing figures described above by an inlet arrangement respectively shown in FIGS. 4*a* and 4*b* in an intermediate stage of construction and after completion.

The pre-fabricated sheet 1''' which is the base of the inlet arrangement is axially substantially shorter than the spacing of the form walls 51, 52. It has a flange 14'' spacedly adjacent the inner form wall 52 and is held in position prior to and during pouring of the pool wall 2 by a bolt 54 whose head holds a large washer against the inner, radial face of the flange 14'', and whose shank passes through the outer form wall 51, a notch 55 making a portion of the bolt 54 readily frangible. Ribs 11 and grooves 12 conformingly interengage the poured concrete of the wall 2.

The centrally apertured plug or ring 4 of cellular polystyrene which is axially interposed between the insert 1''' and the outer form wall 51 has a V-shaped, circumferential groove 41 which permits the axial length of the plug or ring 4 to be reduced to a precise value with the simplest of tools. The plug initially had several, axially spaced grooves 41 and was reduced to the illustrated axial length by splitting the initial blank of foamed plastic along one of the grooves.

After removal of the forms 51, 52, a pipe coupling 91 was coaxially bolted to the flange 14'' as is shown in FIG. 4*b*. The discharge end of a plastic supply pipe 92 is adhesively secured in the coupling 91 in a position in which it abuts against an internal shoulder of the coupling. Another pipe 94 carrying an ornamental, radial flange 93 is inserted into the coupling from inside the pool, and the flange is fastened to the wall 2 by bolts 95 which pass through openings in the facing tiles 67. A nozzle 96 rotatably mounted in the orifice of the pipe 94 permits water supplied through the pipe 92 to be directed inward of the pool in a desired direction.

The bottom drain of the pool is shown in FIG. 5 in an intermediate stage of construction. Two inserts $\mathbf{1}^{iv}$, $\mathbf{1}^{v}$ of polyester-bonded quartz sand are installed prior to pouring in the portions of the pool form which define the shapes of the bottom wall 3 and of one of the upright walls. They engage each other in a bell-and-pivot joint 100. Rubber sleeves 104 line the axially adjacent, joined portions of the two inserts. Lips of the sleeves 104 overlap the two annular, radial end faces 17 of the inserts $\mathbf{1}^{iv}$, $\mathbf{1}^{v}$ which bound a narrow annular gap between the inserts, and a polyvinyl chloride tube 105 frictionally received in the sleeves 104 bridges and seals the gap.

The insert $\mathbf{1}^{iv}$ is an elbow fitting having a wide, upwardly directed opening remote from the horizontally straight, tubular insert $\mathbf{1}^{v}$. An integral boss projecting vertically from the wall of the insert 1'' into the bore of the insert and toward its wide opening is aligned with the center of the opening and provided with a vertical bore 16 in which a drain valve, conventional in itself, will be installed in the completed pool portion, not specifically illustrated, but obvious from the preceding description.

While the invention has been described with particular reference to a swimming pool having cast concrete walls, it is applicable in an obvious manner to other concrete-walled vessels having apertured walls and operating elements of different materials associated with the apertures. Storage and processing tanks for liquids other than water, silos for grain, and storage bins for other particulate solids are merely representative of such other applications.

Tubular inserts pre-fabricated from a mixture of rigid, inorganic particles and a resilient binder of synthetic resin composition combine properties valuable in each of these and many other applications. The exact nature of the particulate component and of the resilient binder will readily be selected to suit particular requirements which may be more demanding than those in swimming pool service. The fact that the tubular inserts of the invention are entirely received within the apertures of the concrete wall widens the choice of suitable materials which are protected by the concrete wall against mechanical damage and many atmospheric agents including solar radiation which accelerates aging of many plastics.

In most applications, it is necessary that the material of the insert be wetted by and integrally bonded to the Portland cement mixture normally constituting the matrix of a concrete wall. The afore-described mixture of quartz sand and an organic resin binder, not necessarily polyester binder, fully meets this requirement. The annular metal disc 20 shown in FIGS. 1*c*, 3*c*, and 5 not only strengthens the mechanical bond between the insert and the concrete wall, it also impedes leakage along the interface of the insert and the wall if a leakage path should have been created by faulty pouring technique. The disc may consist of the conventional low carbon steel commonly employed for reinforcing concrete which bonds firmly both to Portland concrete mixture and to the mixture of sand and polyester resin which preferably constitutes the tubular insert. The thickness of the disc may be as small as 0.5 mm or as great as 3 mm, and it may project beyond the outer circumference of the insert by ten to one hundred times its thickness. It is most effective if anchored in a portion of the insert strengthened by a reinforcing rib 11, and if provided with openings 21 filled with an integral portion of the material constituting the insert.

It should be understood, of course, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A vessel comprising:

(a) a wall of cast concrete formed with an aperture extending therethrough in a predetermined direction;

(b) a tubular insert received in said aperture in sealing, conforming engagement with said concrete, (1) the length of said insert in said direction being not greater than the corresponding length of said aperture, (2) said insert essentially consisting of a solid mixture of a particulate, rigid, inorganic material and a more resilient, synthetic organic resin binder, (3) said insert including means for fastening said insert in the interior of a form while said wall is being built by pouring fluid concrete mixture into said form; and (c) a substantially flat disc of sheet steel partly embedded in said insert and transversely projecting from the same into said concrete, the wall thickness of one longitudinal portion of said insert having said disc inserted therein being greater than the wall thicknesses of two longitudinal portions of said insert longitudinally juxtaposed to said one portion in respective, opposite, longitudinal directions.

2. A vessel as set forth in claim 1, wherein said particulate material is quartz, and said resin is a polyester resin.

3. A vessel as set forth in claim 2, wherein the grain size of said quartz is between 0.04 and 8 mm, said resin amounting to approximately 20% of said mixture.

4. A vessel as set forth in claim 1, wherein the thickness of said sheet steel is 0.5 to 3 mm, and said disc projects from said insert over a distance which is about ten to one hundred times the thickness of said sheet steel.

5. A vessel as set forth in claim 1, wherein the embedded part of said disc is formed with openings therethrough, said openings of said disc being filled with said mixture.

6. A vessel as set forth in claim 1, wherein said insert is formed with a longitudinal bore therethrough, and said fastening means include an annular, apertured wall of said mixture transverse to said direction in said bore.

7. A vessel comprising:

(a) a wall of cast concrete formed with an aperture extending therethrough in a predetermined direction;

(b) a tubular insert received in said aperture in sealing, conforming engagement with said concrete, (1) the length of said insert in said direction being not greater than the corresponding length of said aperture, (2) said insert essentially consisting of a solid mixture of a particulate, rigid, inorganic material and a more resilient, synthetic organic resin binder, (3) said insert including means for fastening said insert in the interior of a form while said wall is being built by pouring fluid concrete mixture into said form; and (c) a substantially flat disc of sheet steel partly embedded in said insert and transversely projecting from the same into said concrete, (1) the embedded part of said disc being formed with openings therethrough, (2) said openings of said disc being filled with said mixture.

8. A vessel as set forth in claim 7, wherein said particulate material is quartz, and said resin is polyester resin.

9. A vessel as set forth in claim 8, wherein the grain size of said quartz is between 0.04 and 8 mm, said resin amounting to approximately 20% of said mixture.

10. A vessel as set forth in claim 4, wherein the thickness of said sheet steel is 0.5 to 3 mm, and said disc projects from said insert over a distance which is about ten to one hundred times the thickness of said sheet steel.

11. A vessel as set forth in claim 7, wherein said insert is formed with a longitudinal bore therethrough, and said fastening means include an annular, apertured wall of said mixture transverse to said direction in said bore.

* * * * *